US005603235A

United States Patent [19]

Um

[11] Patent Number: 5,603,235

[45] Date of Patent: Feb. 18, 1997

[54] FORGING PROCESS FOR TITANIUM ALLOYS

[75] Inventor: Bong Y. Um, Ulsan, Rep. of Korea

[73] Assignee: Hyundai Motor Company, Seoul, Rep. of Korea

[21] Appl. No.: 571,716

[22] Filed: Dec. 13, 1995

[30] Foreign Application Priority Data

Dec. 16, 1994 [KR] Rep. of Korea ..... 94-34681

[51] Int. Cl.[6] ..... B21J 1/06

[52] U.S. Cl. ..... 72/46; 148/246

[58] Field of Search ..... 72/46, 42; 428/450, 428/42; 148/246, 269

[56] References Cited

U.S. PATENT DOCUMENTS

| | | | |
|---|---|---|---|
| 4,281,528 | 8/1981 | Spiegelberg | 72/46 |
| 5,219,617 | 6/1993 | Howard | 427/309 |

FOREIGN PATENT DOCUMENTS

| | | | |
|---|---|---|---|
| 1348132 | 11/1963 | France | 72/42 |
| 005808 | 1/1979 | Japan | 72/46 |
| 0100935 | 6/1983 | Japan | 72/46 |
| 1-95837 | 4/1989 | Japan . | |
| 442866 | 6/1995 | Russian Federation | 72/42 |

*Primary Examiner*—Sam Silverberg

*Attorney, Agent, or Firm*—Finnegan, Henderson, Farabow, Garrett and Dunner, L.L.P.

[57] ABSTRACT

The present invention provides with a water glass layer which prevents oxidation and increases fatigue strength of the alloy. The surface treatment process for preparing the titanium alloy comprises the steps of washing the titanium alloy by alkali cleaning and pickling, drying the alloy in a water glass solution, thereby forming a water glass layer on the surface of the titanium alloy, and forging the titanium alloy.

11 Claims, 2 Drawing Sheets

2 3 1

3 1

FORGING PROCESS FOR TITANIUM ALLOYS

BACKGROUND OF THE INVENTION

1. Field of the Invention

The present invention relates to a forging process for titanium alloys, more particularly to a process for preventing an oxide layer from forming during a forging process for titanium alloys.

2. Description of the Related Art

Recently, the development of a lower fuel consumption and pollution-preventive automobile has been one of the most important goals for the automotive industry.

In general, improving engine performance, improving heat resistance, reducing the weight of engine components, and reducing the running resistance and the weight of the body can improve the fuel efficiency of an automobile internal combustion engine. Improving the engine performance and the heat efficiency can be more easily and directly attained by reducing the weight of engine components, especially reciprocating components such as connecting rods and pistons, rather than reducing the weight of the body. Accordingly, this area has been the focus of a great deal of research and development.

Engine performance and fuel efficiency can be improved by using a light-weight material to reduce an engine component's inertia, thereby reducing friction losses. Titanium alloys having high hardness to weight ratios are good candidate materials for engine components.

In the aerospace industry, titanium is used for light-weight components such as aircraft body frames and wings and jet engine turbine blades because of its excellent heat resistance and hardness.

Although titanium has superior hardness and heat resistance, it is so expensive in comparison to aluminium that its use has been limited. Recently, however, as improved smelting method has been developed and new resource materials have been discovered, the price of titanium has decreased so as to become feasible for widespread use in the automotive industry. Accordingly, many kinds of titanium alloys have been developed for an automotive transmissions and engines which must endure high temperature and mechanical stress.

For example, a titanium alloy containing 10 wt % of vanadium, 2 wt % of iron, and 3 wt % of aluminium is hard and easily forged, a 15-3 titanium alloy containing 15 wt % of vanadium and 3wt % of chromium, aluminium, and tin can be rolled at an ambient temperature, and a titanium alloy containing 2 wt % of vanadium, 2 wt % of tin, 4 wt % of zinc, and 2 wt % of molybdenum exhibits a high temperature resistance.

Japanese Laid-Open Patent No. 89-95837 discloses a process for preparing a β-type titanium alloy material wherein descaled β-type titanium alloy is blasted, zinc-phosphated, washed with water, treated with a reaction-type metal soap, dried and cold-forged.

These titanium alloys, however, form an oxide layer of TiO or $TiO_2$ which weakens the fatigue strength of the alloy.

SUMMARY OF THE INVENTION

Additional features and advantages of the invention will be set forth in the description which follows, and in part will be apparent from the description, or may be learned by practice of the invention. The objectives and other advantages of the invention will be realized and attained by the process particularly pointed out in the written description and claims hereof, as well as the appended drawings.

The present invention solves the above problem and prevents deterioration of the fatigue strength of the titanium alloy at high temperature. It is an object of the present invention to provide a forging process for the titanium alloy to prevent the formation of an oxide layer.

To achieve the above object, the present invention provides a surface treatment process for preparing titanium alloys comprising the steps of dipping the titanium alloy in a water glass solution to form a water glass surface layer on the titanium alloy, drying the water glass surface layer, and forging the titanium alloy.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention.

In the drawings.

DETAILED DESCRIPTION OF THE PREFERRED EMBODIMENTS

In the present invention, the forging process is performed after a layer of water glass(i.e., sodium silicate) is formed on the surface of the titanium alloy to prevent surface oxidation. Therefore, fatigue strength of the titanium alloy can be increased.

There are many kinds of water glasses. The water glass solution preferred in the present invention, however, is composed of about 20–30 wt % of silicon oxide, about 5 wt % of sodium oxide and about 70–80 wt % of water. The pH of the preferred water glass is about pH 10 to pH 11. For homogeneity, economical efficiency and tractability of the coating, the viscosity of the water glass solution should be closely controlled. The preferable viscosity of the water glass solution in the present invention is about 35 to 36 seconds when tested with Ford Cup #4 at 18° C. If the viscosity of the water glass solution is lower than this range, it is difficult to form the coating on the surface of the titanium alloy, and above the range it is difficult to form a homogeneous coating.

In the present invention, the alloy may be cleaned and pickled to remove oil, dirt, oxides, or other impurities from the surface of the titanium alloy before forming the water glass surface layer on the titanium alloy. About 10 to 15 wt % of aqueous sodium hydroxide is used in the preferred alkali cleaning. After alkali cleaning, pickling may be performed by dipping once in a pickling solution comprised of 2% fluoric acid, 15% nitric acid, and 83% water for 3 to 5 minutes.

The preferred method, however, is first dipping the cleaned alloy in a first pickling solution of 1% fluoric acid, 15% nitric acid, and 84% water, and then dipping the alloy in a highly concentrated second pickling solution of 3% fluoric acid, 30% nitric acid, and 77% water. In the preferred pickling process the alloy is held for 3 to 5 minutes in each pickling solution. The pickling step results in a more homogenized water glass coating.

After alkali cleaning and pickling, the water glass layer is formed on the surface of the titanium alloy by dipping it in the water glass solution.

The water glass layer coated on the surface of the titanium alloy is preferably dried in an oven or an electric furnace at about 110° C. to 130° C. for about 5 to 10 minutes. If the water glass is exposed to the atmosphere for a long time, it may flake. Accordingly, the coated titanium alloy should be forged as soon as possible (within 24 hours) after being coated. Shot peening may be performed on the forged alloy to eliminate any residual stress. After the shot peening, the pickling treatment can be performed once more to improve the fatigue strength by removing any partially formed oxide layer.

With reference to the drawings, the effects of the present invention are described particularly as follows.

Figure 1:
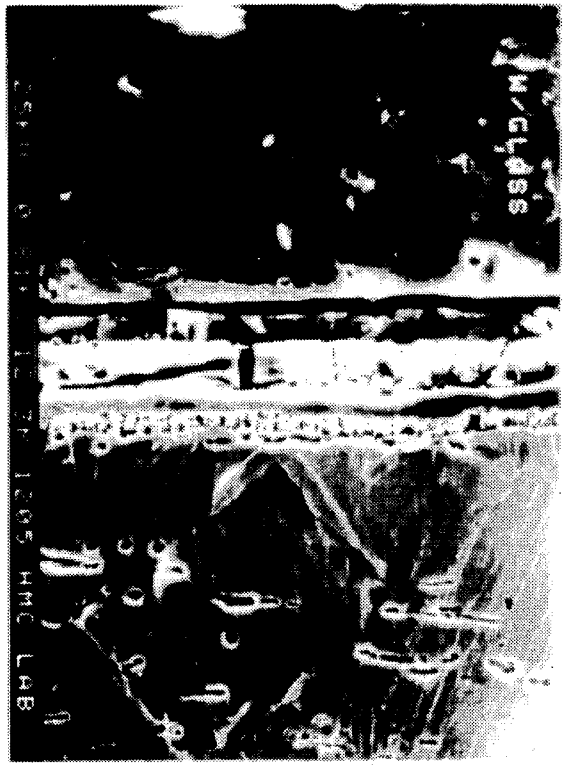
FIG. 1 is an electron microphotograph in which the surface of a product prepared by the process of the present invention is shown.
Figure 2:
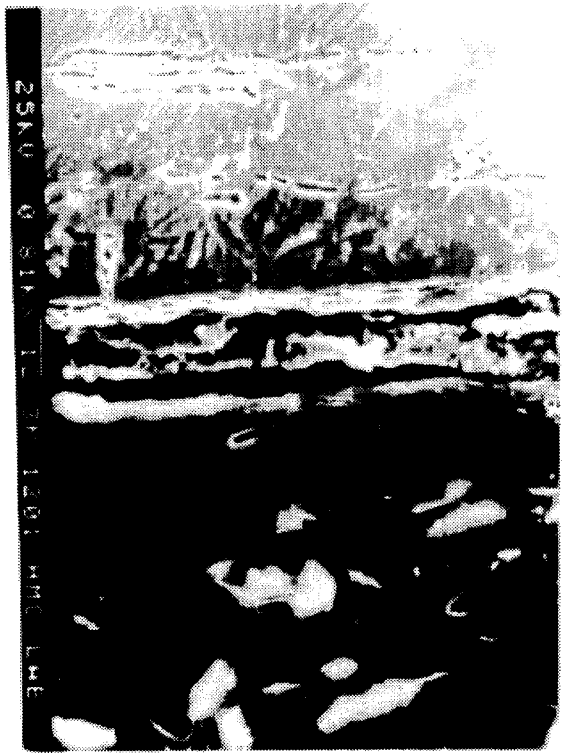
FIG. 2 is an electron microphotograph in which the surface of a product prepared by a prior art is shown.

FIG. 1 is an electron microphotograph of the surface of a forged product prepared by the process of the present invention is shown. FIG. 2 is an electron microphotograph of the surface of a forged product without the protective layer of the instant invention.

As shown in FIGS. 1 and 2, the titanium alloy which is treated by the forging process of the present invention forms an oxide layer of about 3 μm (3 in FIG. 1). In contrast, the titanium alloy without the protective layer forms an oxide layer of about 15 μm (3 in FIG. 2).

Figure 3:
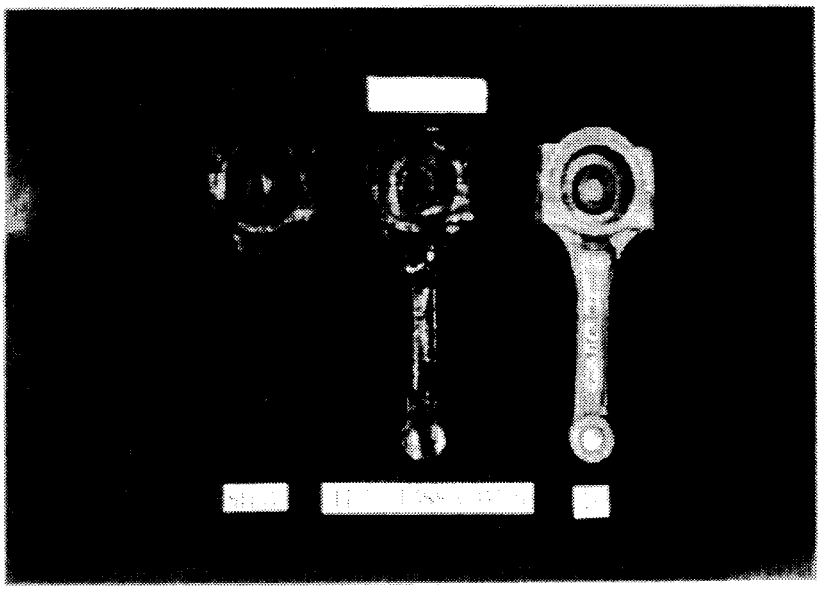
FIG. 3 is a photograph comparing the surface of prior art products produced of steel, titanium, and a titanium alloy prepared by the process of the present invention.

FIG. 3 is a photograph comparing the surface corrosion of prior art connecting rods of steel and titanium alloy prepared by the process of the present invention. As shown in FIG. 3, no corrosion is observed on the forged titanium alloy of the present invention having a protective layer. In contrast, considerable corrosion is observed on the titanium alloy without the protective layer.

As the above results show, the oxidation resistance of a titanium alloy can be improved by a process in which a water glass surface layer is formed before the titanium alloy is forged.

A preferable working example and reference example are described below. These examples are exemplary only, and the present invention is not restricted to the scope of the example.

WORKING EXAMPLE

An ordinary titanium alloy was cleaned in an alkali bath containing 10–15 wt % of aqueous sodium hydroxide for 5 minutes, washed with water, dipped in a pickling solution of 2% fluoric acid, 15% nitric acid, and 83% water for 3 to 5 minutes, washed with the water, dried, dipped in the water glass solution comprising 20–30 wt % of silicon oxide, about 5% of sodium oxide, the remainder water and trace impurities for 10 minutes to form a water glass layer on the surface. It was then dried in an oven or an electric furnace at 110° C. to 130° C. for 5 minutes to form a silicon oxide layer of 20 μm having a fine network structure by removing the water from the surface. A sample was then prepared by forging the titanium alloy having the layer. As shown in FIG. 1, the surface oxide layer of the sample had a thickness of about 3 μm.

REFERENCE EXAMPLE

An ordinary titanium alloy was forged and prepared as a sample. As shown in FIG. 2, the surface oxide layer of the sample has a thickness of about 15 μm.

It will be apparent to those skilled in the art that various modifications and variations can be made in the disclosed process and product without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A process for forging a titanium alloy comprising the steps of:

dipping a titanium alloy in a water glass solution to form a water glass layer on the titanium alloy;

drying the water glass layer; and forging the titanium alloy.

2. The process of claim 1, wherein the water glass solution is an alkaline solution containing about 20–30 wt % of silicon oxide, about 5 wt % of sodium oxide, and about 70–80 wt % of water, and has a pH of about pH 10 to pH 11.

3. The process of claim 1, wherein the viscosity of the water glass is about 35 to 36 seconds when tested with Ford Cup #4 at 18° C.

4. The process of claim 1, wherein the water glass layer of the titanium alloy is dried in an oven or an electric furnace at about 110° to 130° C. for about 5 to 10 minutes.

5. The process of claim 1, further comprising cleaning the alloy in an alkali cleaning solution prior to dipping the alloy in the water glass solution.

6. The process of claim 5, further comprising pickling the alloy in a first pickling solution after cleaning the alloy and prior to dipping the alloy on the water glass solution.

7. The process of claim 6, wherein said first pickling solution is comprised of about 2% fluoric acid, 15% nitric acid, and 83% water.

8. The process of claim 6, further comprising pickling the alloy in a second pickling solution after pickling in the first solution and prior to dipping the alloy in the water glass solution.

9. The process of claim 8, wherein said first pickling solution is comprised of about 1% fluoric acid, 15% nitric acid, and 84% water, and said second pickling solution is comprised of about 3% fluoric acid, 20% nitric acid, and 77% water.

10. The process of claim 6, further comprising shot peening the alloy after forging the alloy.

11. The process of claim 10, further comprising pickling the alloy after shot peening.

* * * * *